US005588895A

United States Patent [19]

Larson

[11] Patent Number: 5,588,895

[45] Date of Patent: Dec. 31, 1996

[54] ANGEL ACTION FIGURE DOLL

[76] Inventor: Diana A. Larson, R.R. 1 Box 33B, Mt. Ayr, Iowa 50854

[21] Appl. No.: 559,233

[22] Filed: Nov. 17, 1995

[51] Int. Cl.[6] ..... A63H 3/08; A63H 33/22; A63H 3/46

[52] U.S. Cl. ..... 446/98; 428/13; 428/16; 446/219; 446/376

[58] Field of Search ..... 63/2; 411/371, 411/402; 428/13, 16; 206/19; 446/97, 98, 99, 219, 268, 330, 352, 354, 376, 378, 379, 390

[56] References Cited

U.S. PATENT DOCUMENTS

| | | | |
|---|---|---|---|
| 153,244 | 7/1874 | Crandall | 446/97 |
| 2,267,094 | 12/1941 | Halsey | 446/219 |
| 2,312,286 | 2/1943 | Reich | 428/3 X |
| 2,313,378 | 3/1943 | Wolf | 428/3 X |
| 2,667,004 | 1/1954 | Sanson | 63/2 X |
| 3,584,667 | 6/1971 | Reiland | 411/402 X |
| 4,254,486 | 1/1981 | Matsumoto et al. | 446/376 X |
| 4,294,036 | 10/1981 | Wion | 428/16 X |
| 4,571,206 | 2/1986 | Mayer et al. | 446/330 |
| 4,867,729 | 9/1989 | Weinman et al. | 428/3 X |
| 5,046,986 | 9/1991 | Wood et al. | 446/98 X |

FOREIGN PATENT DOCUMENTS

| | | | |
|---|---|---|---|
| 166539 | 8/1950 | Austria | 428/3 |
| 1158713 | 6/1958 | France | 428/3 |

OTHER PUBLICATIONS

093015804, Aug. 1993, PCT/US Kelley.

Plastics That Glow In The Dark, Modern Plastics, Oct. 1948, pp. 88–91.

*Primary Examiner*—Robert A. Hafer
*Assistant Examiner*—D. Neal Muir
*Attorney, Agent, or Firm*—Michael I. Kroll

[57] ABSTRACT

An angel action figure doll (10) comprising a small adjustable mannequin (12). A wing assembly (14) is also provided. A structure (16) is for mounting the wing assembly (14) against a back of the small adjustable mannequin (12). A halo (18) is worn on a head (20) of the small adjustable mannequin (12), to simulate a conventional representation of an immortal, spiritual being superior to humans, that is an attendant and messenger of God, which can be used as a plaything of a child.

5 Claims, 5 Drawing Sheets

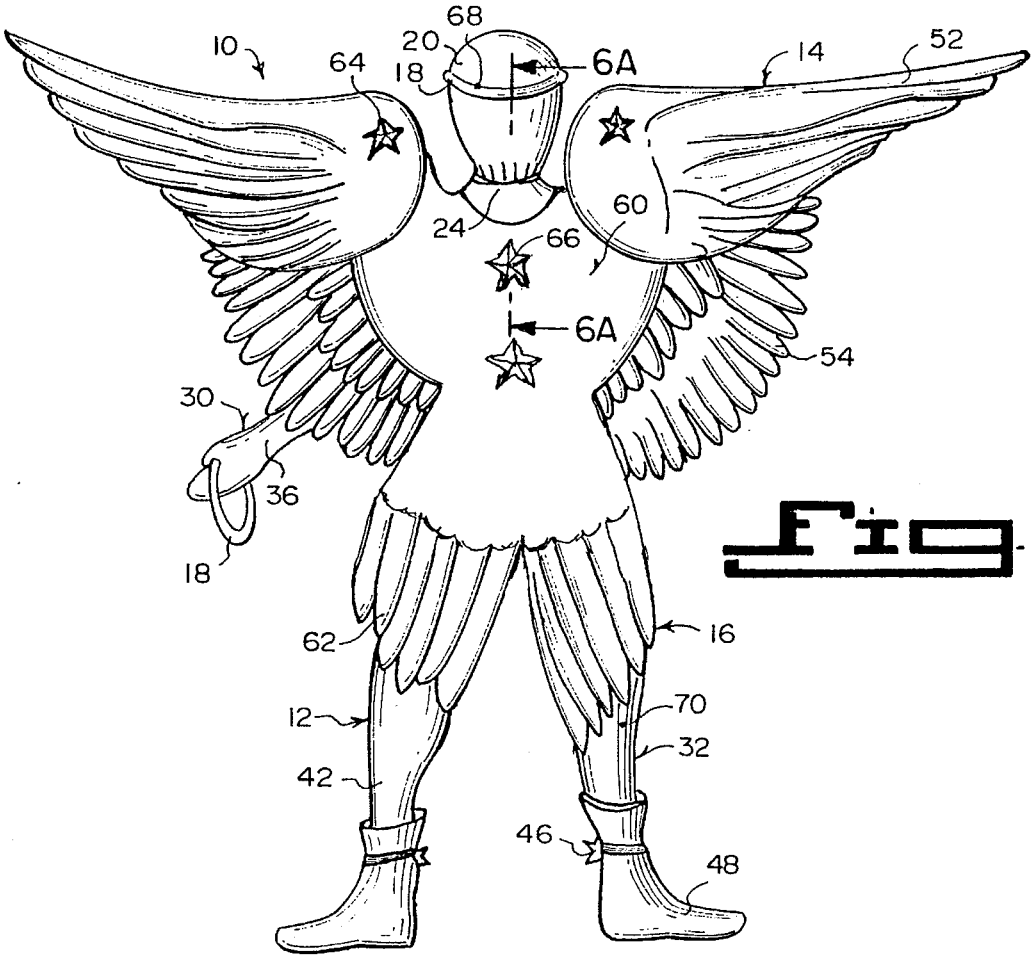
Fig. 2
Fig. 6A
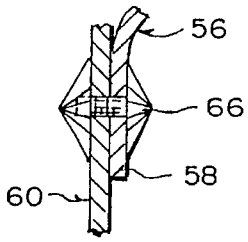
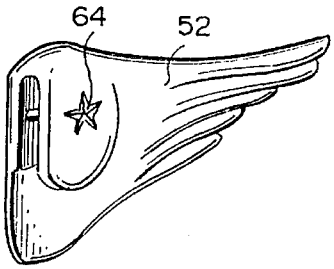
Fig. 3A

ANGEL ACTION FIGURE DOLL

BACKGROUND 0F THE INVENTION

1. Field of the Invention

The instant invention relates generally to dolls and more specifically it relates to an angel action figure doll.

2. Description of the Prior Art

Numerous dolls have been provided in prior art that are adapted to represent small figures of human beings used especially as children's playthings. While these units may be suitable for the particular purpose to which they address, they would not be as suitable for the purposes of the present invention as heretofore described.

SUMMARY OF THE INVENTION

A primary object of the present invention is to provide an angel action figure doll that will overcome the shortcomings of the prior art devices.

Another object is to provide an angel action figure doll which is a conventional representation of an immortal, spiritual being superior to humans, that is an attendant and messenger of God.

An additional object is to provide an angel action figure doll which is in the image of a human form having a halo and adjustable wings, so that it can be played with by a child.

A further object is to provide an angel action figure doll that is simple and easy to use.

A still further object is to provide an angel action figure doll that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 2 is a rear view taken in the direction of arrow 2 in FIG. 1.

FIG. 3A is a front perspective view taken in the direction of arrow 3A in FIG. 1 of one of the upper wings.

FIG. 6A is a cross sectional view taken along line 6A—6A in FIG. 2, showing the breastplate collar connection to the back plate.

Similar reference characters denote corresponding features consistently throughout the attached drawings.

DETAILED DESCRIPTION OF THE PREFERRED EMBODIMENTS

Figure 1:
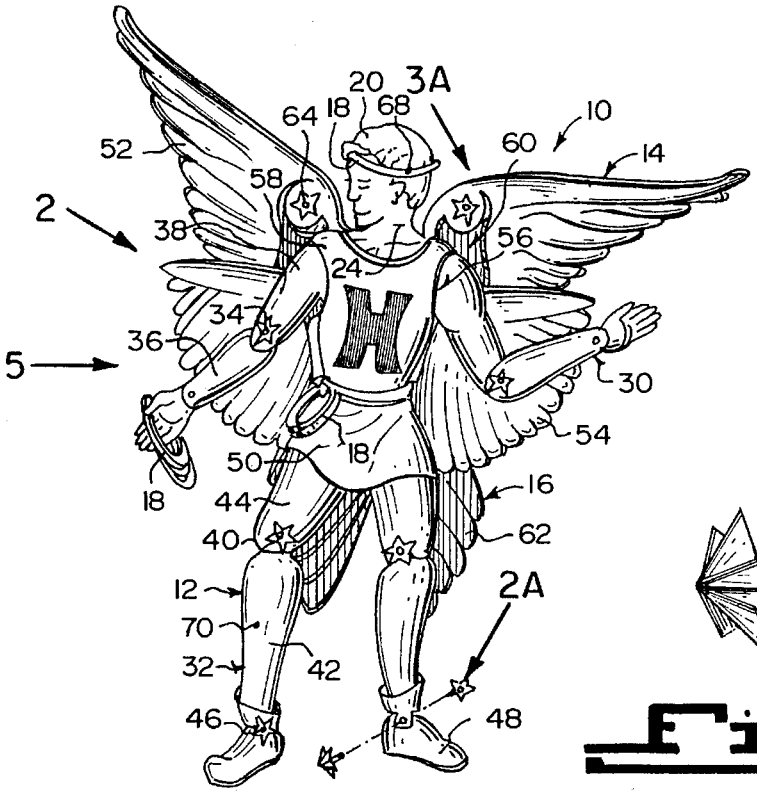
FIG. 1 is a front perspective view of a first embodiment of the instant invention being an inspirational angel in a standing position with the wings up.

Turning now descriptively to the drawings, in which similar reference characters denote similar elements throughout the several views, FIGS. 1, 2, 5 and 7 through 9 illustrate an angel action figure doll 10, comprising a small adjustable mannequin 12. A wing assembly 14 is also provided. A structure 16 is for mounting the wing assembly 14 against a back of the small adjustable mannequin 12. A halo 18 is worn on a head 20 of the small adjustable mannequin 12, to simulate a conventional representation of an immortal, spiritual being superior to humans, that is an attendant and messenger of God, which can be used as a plaything of a child.

Figure 1A:
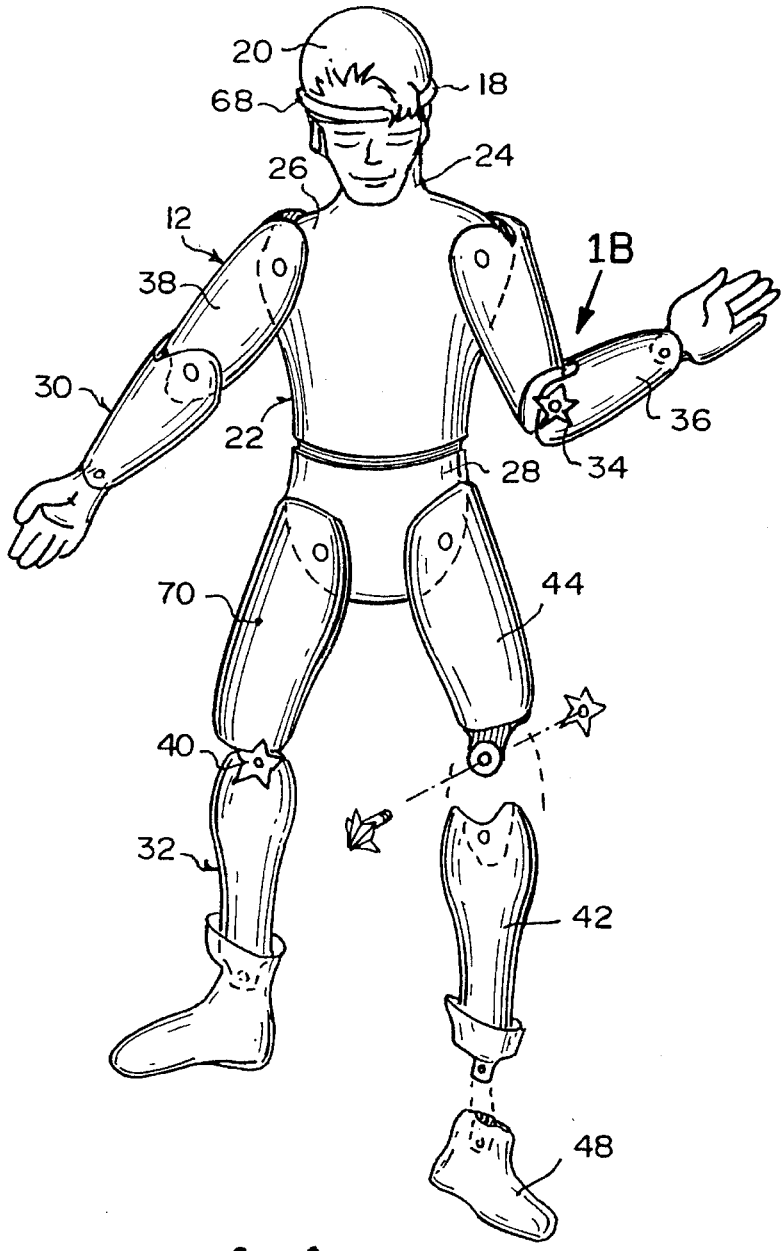
FIG. 1A is a front perspective view partly exploded of just the body of the first embodiment in the standing position.

The small adjustable mannequin 12, as best seen in FIG. 1A, is in the form of a human being and includes a torso 22 having a neck 24, shoulders 26 and hips 28. The head 20 swivels on the neck 24 of the torso 22. A pair of jointed arms 30 extend outwardly from the shoulders 26 of the torso 22. A pair of jointed legs 32 extend downwardly from the hips 28 of the torso 22.

Figure 1B:
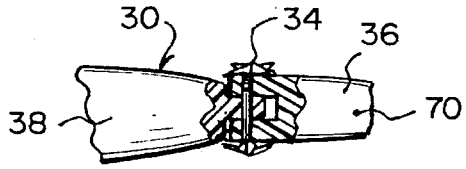
FIG. 1B is a top view taken in the direction of arrow 1B in FIG. 1A of a portion of the arm at the elbow joint with parts broken away and in section.

Each jointed arm 30, as best seen in FIG. 1B, contains a star elbow joint assembly 34 between a forearm segment 36 and upper arm segment 38 thereof. Each jointed leg 32 includes a star knee joint assembly 40 between a shank segment 42 and thigh segment 44 thereof.

Figure 2A:
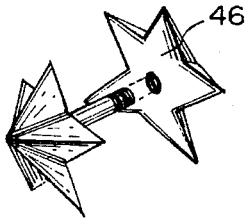
FIG. 2A is an enlarged exploded perspective view as indicated by arrow 2A in FIG. 1, of one typical star joint assembly.

Each jointed leg 32 also includes a star ankle joint assembly 46 between a boot segment 48 and the shank segment 42 thereof (see FIG. 2A). A toga 50 is worn by the small adjustable mannequin 12.

The wing assembly 14 consists of a pair of upper wings 52 and a pair of lower wings 54. One of the upper wings 52 is best shown in FIG. 3A.

Figure 3:
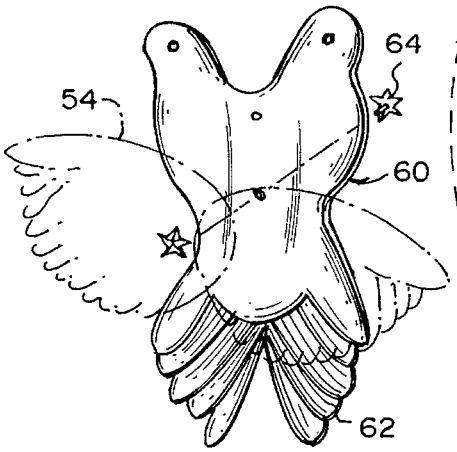
FIG. 3 is a front view of the back plate, showing the lower wings in phantom ready to be installed thereto.
Figure 4:
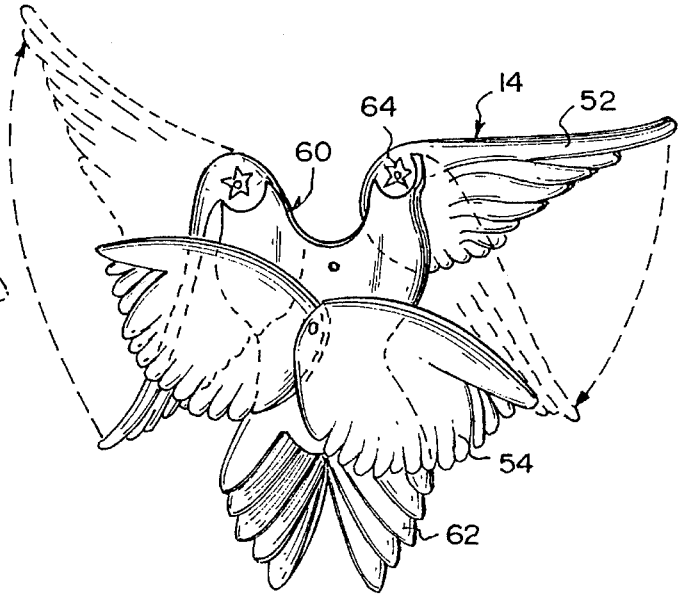
FIG. 4 is a front view similar to FIG. 3, showing the lower wings and upper wings installed to the back plate.
Figure 6:
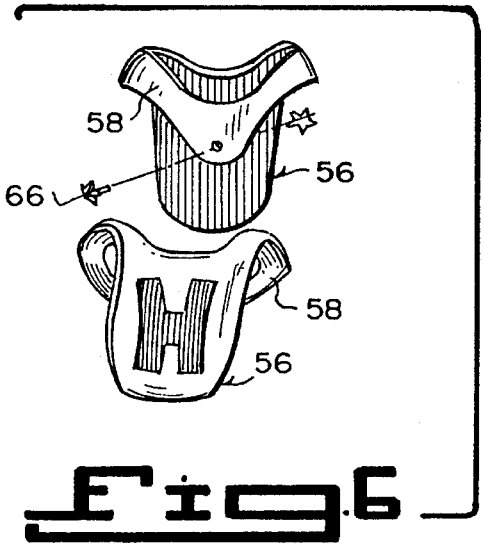
FIG. 6 illustrates front and rear perspective views of the breastplate.

The mounting structure 16 includes a breastplate 56, having a collar 58 to be worn about the neck 24 and shoulders 26 of the small adjustable mannequin 12 (see FIG. 6). A back plate 60, having a tail 62 is also provided, as best seen in FIGS. 3 and 4.

Three star swivel assemblies 64 are for attaching the pair of upper wings 52 and a pair of lower wings 54 of the wing assembly 14 to the back plate 60 in a moveable manner. A star connector assembly 66, as best seen in FIG. 6A, is for securing the back plate 60 to the collar 58 of the breastplate 56.

The halo 18 can carry a small star 67 and is fabricated out of an elastic material 68 that glows in the dark. The small adjustable mannequin 12 is fabricated out of a semi-soft plastic material 70.

Figure 5:
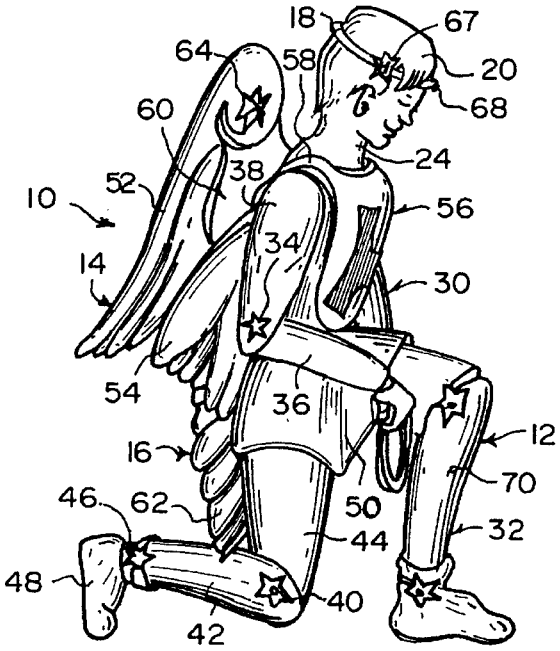
FIG. 5 is a side perspective view taken in the direction of arrow 5 in FIG. 1, showing the first embodiment kneeling on one knee with the wings down.
Figure 7:
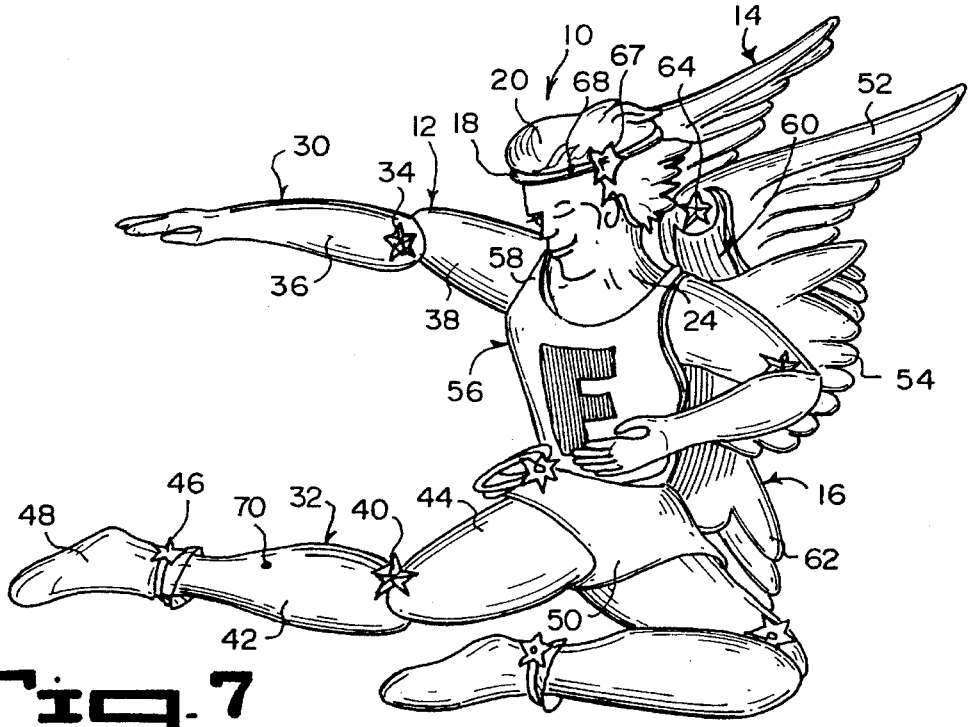
FIG. 7 is a front perspective view of a second embodiment of the instant invention being a fight evil angel in a fighting position.

In FIGS. 1, 5 and 6, the breastplate 56 contains a large letter "H" thereon, to indicate that the angel action figure doll 10 is representative of an inspirational angel. In FIG. 7, the small adjustable mannequin 12 is muscular and the breastplate 16 contains a large letter "F" thereon, to indicate that the angel action figure doll 10 is representative of a fight evil angel.

Figure 8:
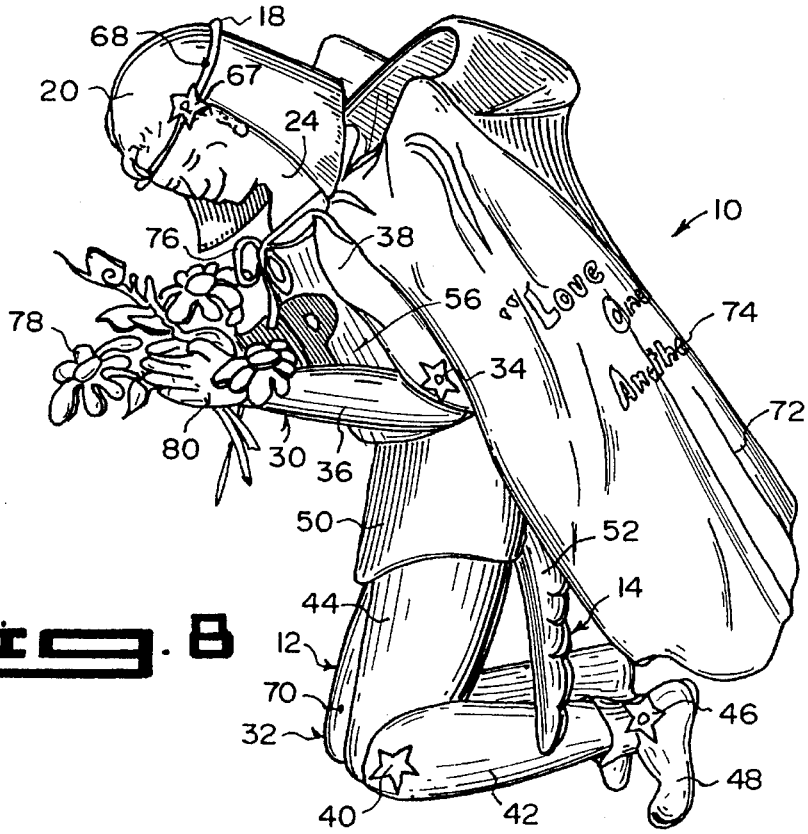
FIG. 8 is a side perspective view of a third embodiment of the instant invention being a prayer angel in a kneeling position.

In FIG. 8, the breastplate 56 contains a large letter "P" hereon, to indicate that the angel action figure doll 10 is representative of a prayer angel. The angel action figure doll 10 in FIG. 8 further includes a cape 72, having a saying 74 thereon with tie strings 76, so that the cape 72 can be worn about the neck 24 of the small adjustable mannequin 12. A plurality of simulated cut flowers 78 are grasped by the hands 80 of the small adjustable mannequin 12.

Figure 9:
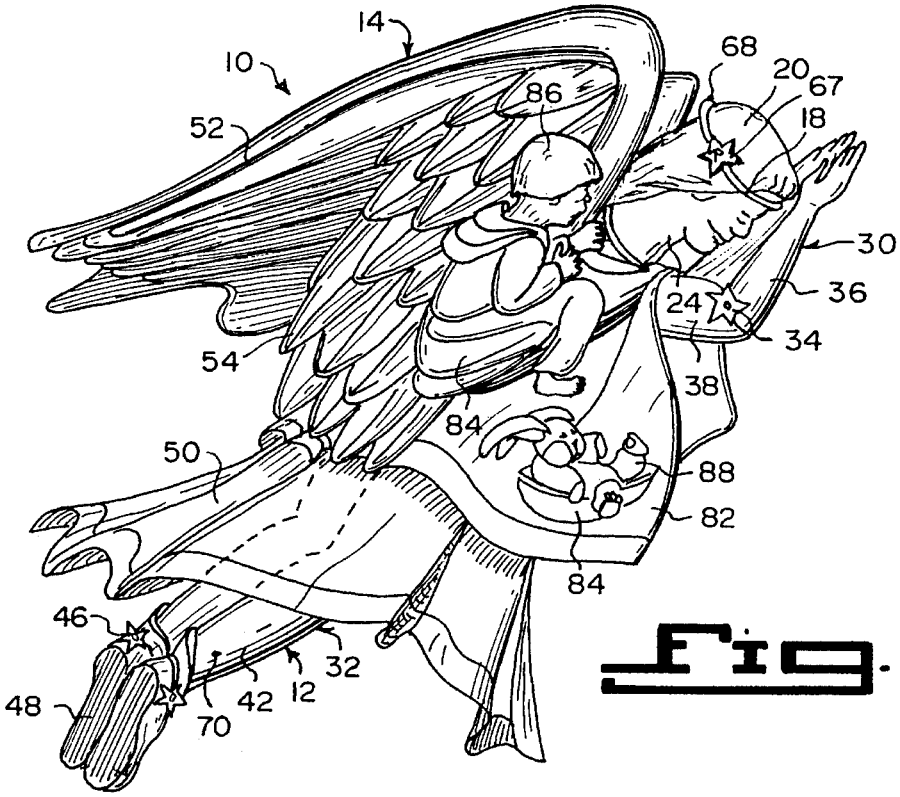
FIG. 9 is a rear perspective view of a fourth embodiment of the instant invention being a riding angel in a flying position.

The angel action figure doll 10, as shown in FIG. 9, contains a cape 82 having a plurality of pockets 84, to carry a child doll 86 and toys 88 therein. The angel action figure doll 10 is representative of a riding angel.

LIST OF REFERENCE NUMBERS

10 angel action figure doll
12 small adjustable mannequin of 10
14 wing assembly of 10
16 mounting structure of 10
18 halo of 10
20 head of 12
22 torso of 12
24 neck of 22
26 shoulder of 22
28 hip of 22
30 jointed arm
32 jointed leg
34 star elbow joint assembly of 30
36 forearm segment of 30
38 upper arm segment of 30
40 star knee joint assembly of 32
42 shank segment of 32
44 thigh segment of 32
46 star ankle joint assembly of 32
48 boot segment of 32
50 toga on 12
52 upper wing of 14
54 lower wing of 14
56 breastplate of 16
58 collar on 56
60 back plate of 16
62 tail on 60
64 star swivel assembly of 16
66 star connector assembly of 16
67 small star on 18
68 elastic material of 18 glows in dark
70 semi-soft plastic material of 12
72 cape
74 saying on 72
76 tie strings on 72
78 simulated cut flower
80 hand of 12
82 cape
84 pocket in 82
86 child doll in 84
88 toy in 84

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An angel action figure doll comprising:

a) a small adjustable mannequin, said small adjustable mannequin being in the form of a human being and including a torso having a neck, shoulders and hips, a head that swivels on the neck of said torso, a pair of jointed arms that extend outwardly from the shoulders of said torso, and a pair of jointed legs that extend downwardly from the hips of said torso, each said jointed arm including a star elbow joint assembly between a forearm segment and upper arm segment thereof, each said jointed leg including a star knee joint assembly between a shank segment and thigh segment thereof, each said jointed leg including a star ankle joint assembly between a boot segment and a shank segment thereof said small adjustable mannequin being fabricated out of a semi-soft plastic material;

b) a wing assembly, said wing assembly including a pair of upper wings, and pair of lower wings;

c) means for mounting said wing assembly against a back of said small adjustable mannequin, said mounting means including a breastplate having a collar to be worn about a neck and shoulders of said small adjustable mannequin, a back plate having a tail, three star swivel assemblies for attaching a pair of upper wings and a pair of lower wings of said wings assembly to said back plate in a moveable manner, and a star connector assembly for securing said back plate to the collar of said breastplate, d) a halo worn on a head of said small adjustable mannequin, to simulate a conventional representation of an immortal, which can be used as a plaything of a child, said halo carrying a small star and being fabricated out of an elastic material that glows in the dark;

e) a toga worn by said small adjustable mannequin.

2. An angel action figure doll as recited in claim 1 wherein said small adjustable mannequin is muscular and said breastplate includes a large letter "F" thereon, to indicate that said angel action figure doll is representative of a fight evil angel.

3. An angel action figure doll as recited in claim 1, wherein said breastplate includes a large letter "P" thereon, to indicate that said angel action figure doll is representative of a prayer angel.

4. An angel action figure doll as recited in claim 3, further including:

a) a cape having a saying thereon with tie strings, so that said cape can be worn about a neck of said small adjustable mannequin; and b) a plurality of simulated cut flowers to be grasped by the hands of said small adjustable mannequin.

5. An angel action figure doll as recited in claim 1, further including a cape having a plurality of pockets to carry a child doll and toys therein, whereby said angel action figure doll is representative of a riding angel.

* * * * *